United States Patent [19]

Schweitzer

[11] Patent Number: 4,800,800

[45] Date of Patent: Jan. 31, 1989

[54] FLUID PRESSURE TRANSLATING DEVICE

[75] Inventor: Jean J. Schweitzer, Brandon, Miss.

[73] Assignee: Vickers, Incorporated, Troy, Mich.

[21] Appl. No.: 188,639

[22] Filed: May 2, 1988

Related U.S. Application Data

[63] Continuation of Ser. No. 898,391, Aug. 20, 1986, abandoned.

[51] Int. Cl.[4] ..... F01B 13/04

[52] U.S. Cl. ..... 91/483; 91/505; 417/315

[58] Field of Search ..... 91/483, 504, 505, 475, 91/482; 417/315, 222, 270; 92/12.2

[56] References Cited

U.S. PATENT DOCUMENTS

| | | | |
|---|---|---|---|
| 1,908,612 | 5/1933 | Johnson | 417/315 X |
| 2,847,938 | 8/1958 | Gondek | 91/483 X |
| 3,139,037 | 6/1964 | Budzich | 91/483 |
| 3,166,016 | 1/1965 | Thoma | 91/483 |
| 3,190,232 | 6/1965 | Budzich | 91/475 X |
| 3,202,105 | 8/1965 | Badenoch et al. | 91/482 |
| 3,636,821 | 1/1972 | Rystrom | 91/475 X |
| 3,756,749 | 9/1973 | Aldinger | 417/220 |
| 4,160,403 | 7/1979 | Takagi | 91/483 |
| 4,529,362 | 7/1985 | Ichiryu et al. | 417/271 |
| 4,531,898 | 7/1985 | Ideta | 417/220 X |

FOREIGN PATENT DOCUMENTS

| | | | |
|---|---|---|---|
| 2420669 | 11/1979 | France | 91/482 |
| 42384 | 11/1907 | Switzerland | 91/483 |

*Primary Examiner*—Paul F. Neils

*Attorney, Agent, or Firm*—Barnes, Kisselle, Raisch, Choate, Whittemore & Hulbert

[57] ABSTRACT

A fluid pressure translating device comprising a housing with a pumping mechanism therein including a rotary cylinder barrel having a plurality of cylinders with pistons slidable therein operatively associated with a cam block, each cylinder having a port opening to a valving base of the cylinder barrel, an inlet passage and outlet passage and a valve plate associated with the cylinder barrel and provided with inlet and outlet ports respectively in communication with the inlet and outlet passages. The cam block is rotatable to vary the circumferential position of the cam block relative to the valve plate thereby varying the displacement of the pumping mechanism.

1 Claim, 5 Drawing Sheets

FLUID PRESSURE TRANSLATING DEVICE

This is a continuation of co-pending application Ser. No. 898,391 filed on Aug. 20, 1986, now abandoned.

This invention relates to power transmissions and particularly to pressure energy translating devices of the rotary type.

BACKGROUND AND SUMMARY OF THE INVENTION

The invention is generally concerned with fluid pumps or motors of the rotary axial piston type, and in particular with an improved variable displacement device of this type. For the purposes of convenience, the invention will be described as a fluid pump, but it should be understood that the term pump when used hereafter in the specification and claims embraces both a fluid pump and a fluid motor.

Such devices comprise a casing within which is a rotary cylinder barrel having a plurality of parallel cylinder bores within which pistons reciprocate, the pistons extending from the cylinder barrel to either directly abut camming means, such as a thrust plate member, or being associated therewith by means of articulated connecting rods. The cylinder barrel rotates against a valve plate having inlet and outlet ports, which serves in a well-known manner to provide properly phased communication between the end ports of the cylinder bores within which the pistons reciprocate and inlet and outlet passages of the device. Examples of the type of devices described are disclosed in U.S. Pat. No. 3,108,542.

In such devices, the axis of the thrust plate member is inclined relative to the axis of rotation of the cylinder barrel for reciprocating the pistons, the total displacement of the device being resolved by the relative angle of inclination between the axes of the two members, since the displacement of each piston is determined by the area of the cylinder bore and the length of stroke of the piston, and the length of stroke of the piston is determined by the relative angle of inclination of the axis of rotation of the cylinder barrel and the axis of the thrust plate member.

It has been the practice, therefore, to vary the displacement of such devices by providing a swinging yoke for changing the angle of tilt of the cylinder barrel to vary piston stroke length or by providing mechanism for changing the angle of tilt of the thrust plate member to vary piston stroke length, which yoke or other mechanism may be manually or fluid pressure operated. Examples of two such forms of variable displacement devices are disclosed in U.S. Pat. Nos. 2,565,208 and 2,708,879.

It has also been proposed and has been used successfully to provide a fluid pressure energy translating device of the rotary axial piston type which includes a housing, a rotary cylinder barrel and associated pistons, a cam block and a rotatably mounted valve plate which can be rotated to vary the displacement of the pumping mechanism as shown in U.S. Pat. No. 3,108,542.

Among the objectives of the present invention are to provide a variable delivery energy translating device of an improved type which does not require the use of a movable yoke plate or the use of a rotary valve plate.

In accordance with the invention, a fluid pressure translating device comprising a housing with a pumping mechanism therein including a rotary cylinder barrel having a plurality of cylinders with pistons slidable therein operatively associated with a cam block, each cylinder having a port opening to a valving base of the cylinder barrel and means forming an inlet and outlet passage and a valve plate associated with the cylinder barrel and provided with inlet and outlet ports respectively in communication with the inlet and outlet passages. The cam block is rotatable to vary the circumferential position of the cam block relative to the valve plate thereby varying the displacement pumping mechanism.

Figure 1:
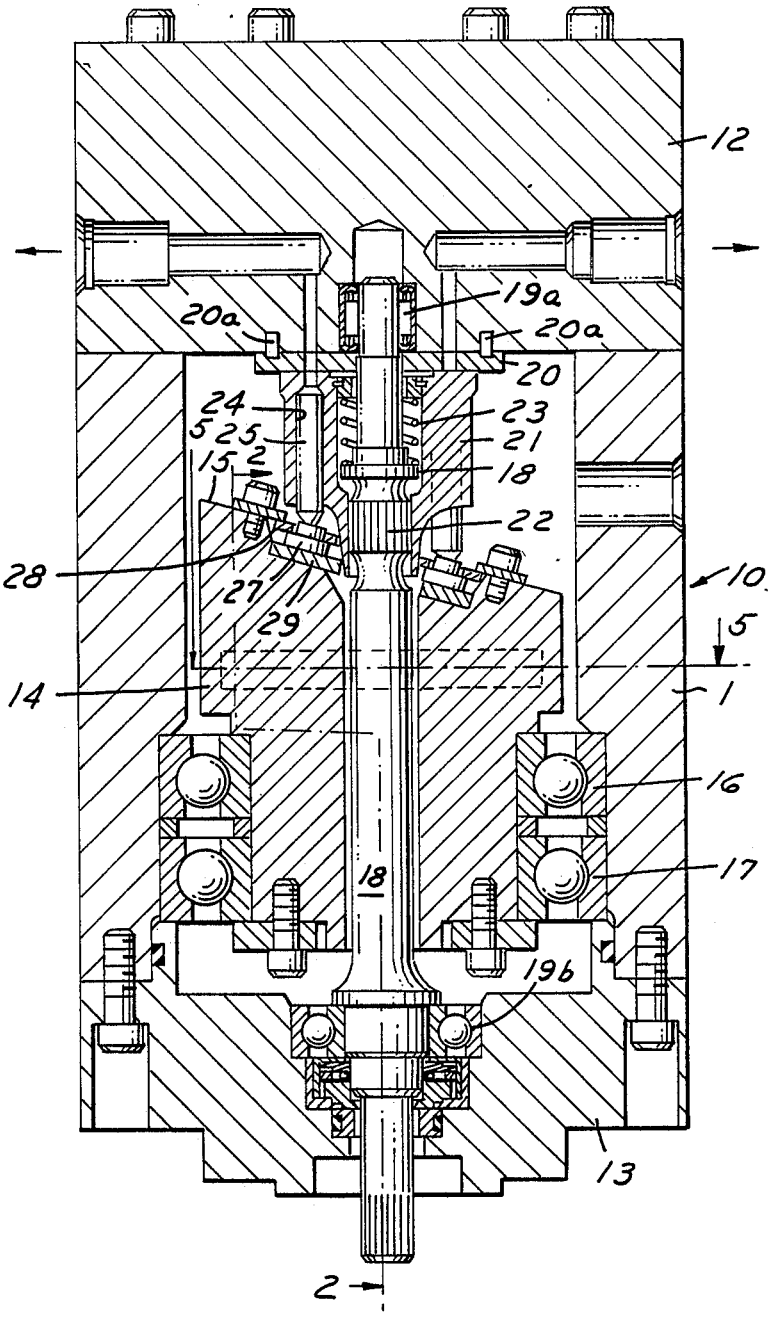
FIG. 1 is a longitudinal sectional view of a pressure energy translating device embodying the invention.

The general construction of the device is such as shown in U.S. Pat. Nos. 2,776,627, 3,481,277 and 3,457,873, which are incorporated herein by reference.

In accordance with the invention, the cam body 14 is rotatably mounted in the housing by the bearings 16, 17 instead of being fixed in the housing as in conventional construction.

By moving the cam body 14 about its axis, the relationship of the top dead center location of the shoes 27 to the inclined surface 15 of the cam block is varied with respect to the timing dictated by the valve plate 20.

By rotating the cam body through 90°, the range of flow may be changed from full delivery to cut off.

Figure 2:
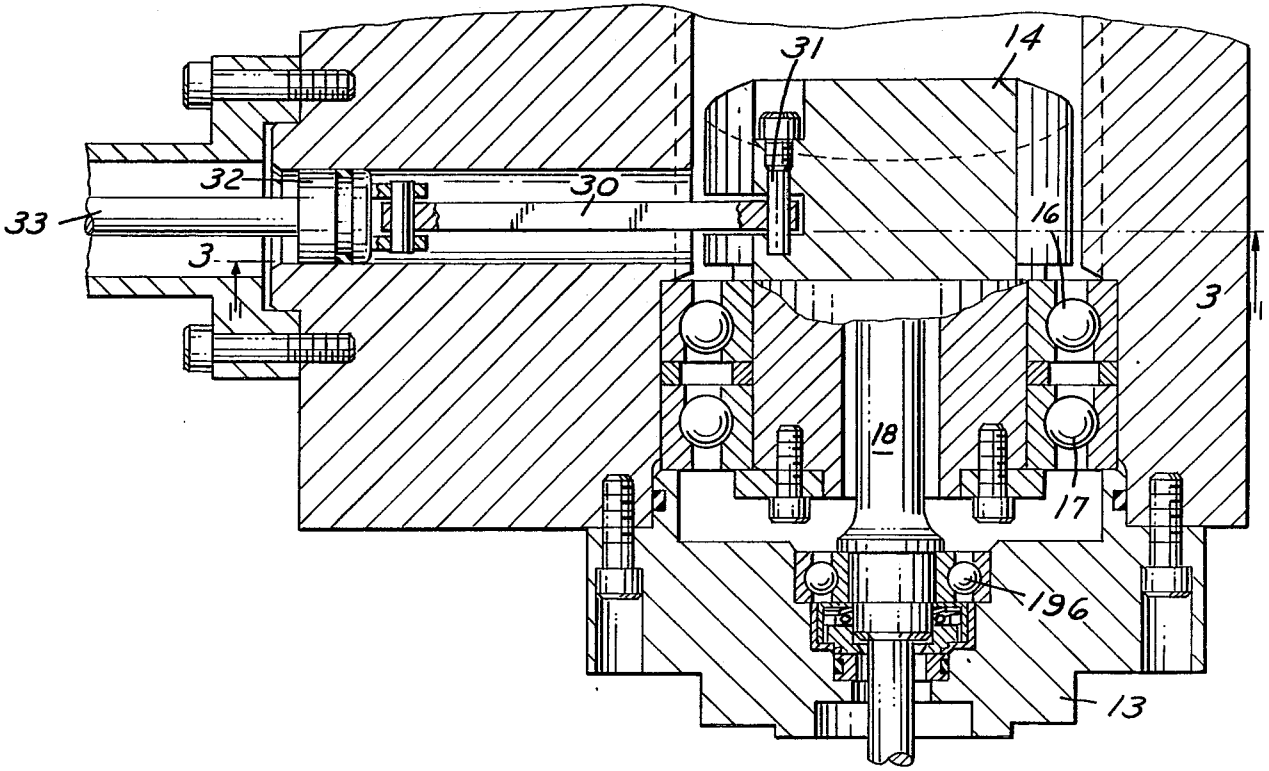
FIG. 2 is a sectional view taken along the line 2—2 in FIG. 1.
Figure 3:
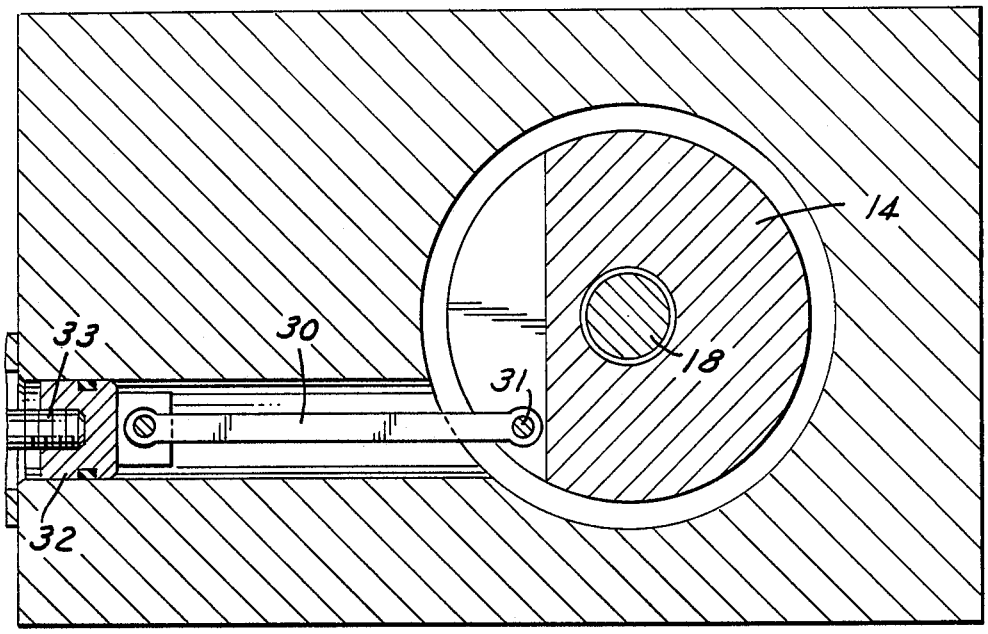
FIG. 3 is a sectional view taken along the line 3—3 in FIG. 2.

The cam block 14 may be rotated by any suitable means. As shown in FIGS. 2 and 3, a link 30 extends through an opening in the side of housing 10 and the cam block 14 is pivoted by a pin 31 to the cam block 14 at a point radially outwardly of the axis of the cam block. The link 30 extends generally radially outwardly and is pivoted to a piston 32 which, in turn, may be operated by a hand lever 33. Piston 32 is provided with a seal isolating the hydraulic fluid in the device from the exterior.

Figure 4:
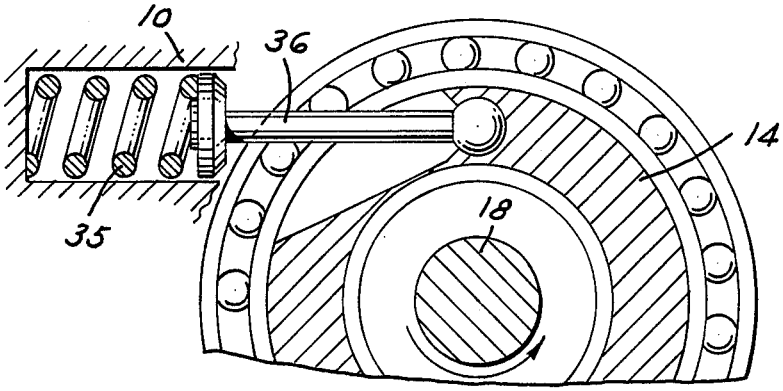
FIG. 4 is a part sectional view of a modified form of device.

In the form shown in FIG. 4, a spring 35 yieldingly urges a link 36, pivoted by a pin 37 to the cam block 14 in a direction resisting the torque transmitted by the input shaft on the cam body 14. This functions to provide a constant torque load in a very simplified manner.

The above relationship can be represented by the following analysis:

Since the simple relation exists between torque, pressure and displacement $\theta$ $$\text{Torque} = \frac{\theta}{6.282} \times \text{Pressure}$$

the device will function as a constant torque pump which will destroke as a function of pressure $$\theta = K \frac{1}{\text{Pressure}}$$

Thus, the spring 35 opposes the force which tends to move the cam block toward a lesser displacement.

Figure 5:
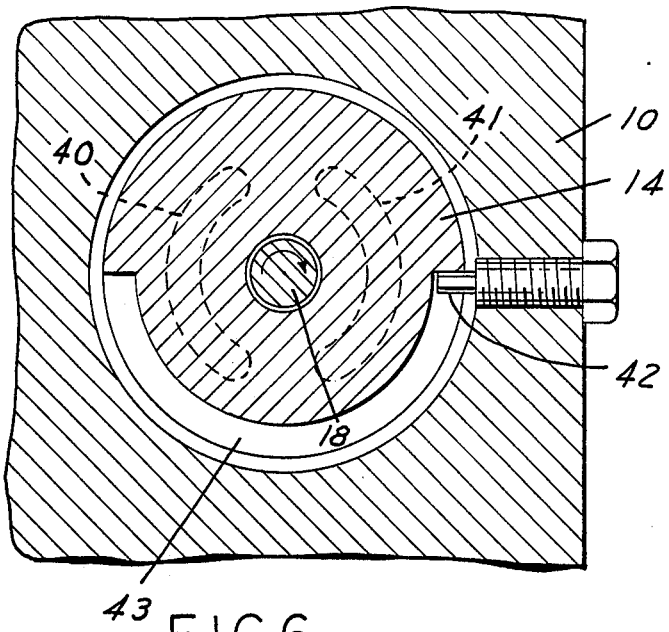
FIG. 5 is fragmentary sectional view taken substantially along the line 5—5 in FIG. 1.

Referring to FIG. 5, it is desirable to provide means for limiting the relative rotation of the cam body 14 to the housing in opposite directions relative to an initial position wherein the cam block 14 is at an initial position and rotation in the opposite direction produces the same or different displacements. As shown in FIG. 5, the kidney-shaped openings 40, 41 are shown in broken lines representing the inlet and outlet in the valve plate 20. As the cam block 14 is rotated, displacement is varied. In order to control the displacement in each direction, a radial pin 42 is provided in the body 10 and extends into an arcuate slot 43 in the periphery of the cam block 14. As the cam block 14 is rotated, the pin engages the extremities of the slot 43 limiting the arcuate extent of movement. As shown, the movement is the same in both directions but can be made different as may be required by the circumstances. For example, if it is desirable to use a pumping scheme which must accept both directions of rotation and also serve as a load pump (for example as a load to a reversing gear box, or as a load to absorb the energy of a pendulum), it can be achieved without any changes in the hydraulic circuitry to reverse the flow. Rotation of 180° of the angle block and a simultaneous reversal of rotation will permit the fluid to enter the pump at the previous inlet kidney slot while exiting at the previous outlet kidney slot.

Figure 6:
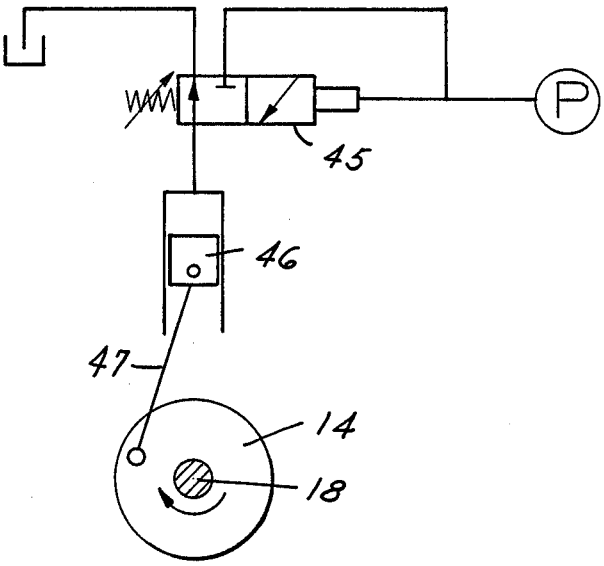
FIG. 6 is a schematic diagram of a system for varying the displacement of the pressure energy translating device.

FIG. 6 shows a typical example of an arrangement for automatically varying the displacement. In this schematic, the output from a pump embodying the invention is provided as represented by P to a spring loaded valve 45. When the pressure of the outlet fluid exceeds a predetermined amount, it is applied to a piston 46 connected by a link 47 to the cam block 14 to lessen or reduce the displacement of the pump.

Figure 7:
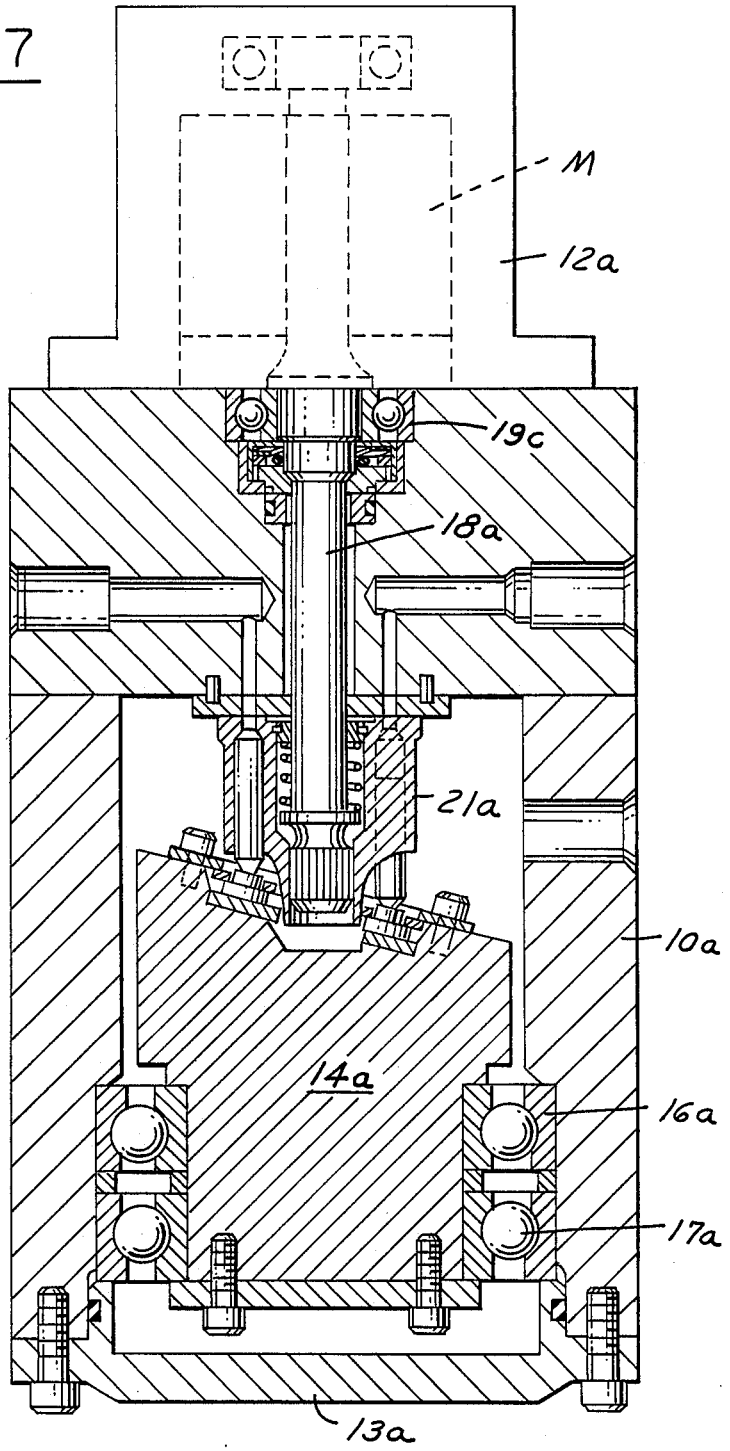
FIG. 7 is a longitudinal sectional view of a modified form of pressure energy translating device. DESCRIPTION Referring to FIGS. 1-3, the pressure energy translating device shown herein is of the axial piston type and comprises a housing 10 formed of a cylindrical portion 11 and end plates 12, 13 bolted thereto. A cam member 14 having an inclined face 15 is rotatably mounted in the housing 10 by bearings 16, 17 and a shaft 18 extends through an opening in the cam body 14 and is rotatably mounted in the housing by bearings 19*a*, 19*b*. A valve plate 20 is fixed on the end member 12 of housing 10 by pins 20*a* and a rotary cylinder barrel 21 is mounted on the shaft 18 by a spline connection 22 for rotation therewith. A spring 23 interposed between a washer on the shaft 18 and a ring on the barrel 21 yieldingly urges the barrel into engagement with the valve plate 20. The barrel 21 has a plurality of cylinders 24 with pistons 25 slidable therein operatively associated with the cam body 14 by a thrust plate member 29 which includes cam shoes 27 that engage a plate 28 rotatably mounted on the cam block 14.

The form of the invention shown in FIG. 7 is similar to that shown in FIG. 1 except that the shaft 18*a* extends only through one end member 12*a* and is cantilevered mounted by a bearing 19*c*. The end block 20*a* supports an electric motor M for operating the device as a pump.

Among the advantages of the present invention are

1. Use of a "fixed design" to obtain variable flow.

2. Capability by placing a retaining element such as a bearing on the angle block to use the ramp forces to turn the angle block providing two different pump displacements with two directions of shaft rotation with no external control.

3. Capability of rotating the block as per 2 for 180° of travel providing a pump capable of delivering output flow at a constant port when the rotation of the shaft is reversed.

4. Allows for the integration of a cartridge by placing the bearing supporting the angle block within the cartridge.

5. Provides a lower cost and lower envelope design than by using the usual yoke.

6. Allows for easy installation at the end of the protruding shaft of an electric motor and reduces the cost by removing coupling shaft, yoke, yoke bearings, shaft and shaft bearing.

7. Permits the provision of a constant torque pump with minimal structural change.

What is claimed is:

1. A fluid pressure energy translating device comprising a housing, a pumping mechanism within said housing, said pumping mechanism including a rotary cylinder barrel mounted for rotation about a drive axis within said housing and having a plurality of axial cylinders with pistons slidable therein, a cam block having an inclined face operatively associated with said pistons, each cylinder having a port opening to a valving base on the cylinder barrel, means for forming an inlet passage and an outlet passage, a valve plate associated with said cylinder barrel and provided with inlet and outlet ports, respectively, in communication with the inlet and outlet passages, means for supporting said cam block for rotation about said axis within said housing such that the circumferential position of the cam block relative to the valve plate may be varied thereby varying the displacement of the pumping mechanism, said cam block being rotatable between a position of maximum displacement and a position of minimum displacement, said cam block being subjected to torque of said pumping mechanism during operation thereof urging said cam block rotatably about said axis toward said position of minimum displacement, and spring means within said housing acting directly on said cam block from a direction tangential to said axis for yieldingly urging said cam block circumferentially about said axis toward said maximum fluid displacement position and opposing movement of said cam block toward a lesser displacement position thereby resisting the torque transmitted by the pumping mechanism on the cam block and providing a constant torque.

* * * * *